US007909099B2

(12) United States Patent
Thiercelin

(10) Patent No.: US 7,909,099 B2
(45) Date of Patent: Mar. 22, 2011

(54) WELL PRODUCTIVITY ENHANCEMENT METHODS

(75) Inventor: Marc Jean Thiercelin, Ville d'Avray (FR)

(73) Assignee: Schlumberger Technology Corporation, Cambridge, MA (US)

( * ) Notice: Subject to any disclaimer, the term of this patent is extended or adjusted under 35 U.S.C. 154(b) by 77 days.

(21) Appl. No.: 11/859,435

(22) Filed: Sep. 21, 2007

(65) Prior Publication Data

US 2008/0073082 A1 Mar. 27, 2008

(30) Foreign Application Priority Data

Sep. 22, 2006 (RU) ..... 2006133834

(51) Int. Cl.
*E21B 43/26* (2006.01)
*E21B 33/13* (2006.01)

(52) U.S. Cl. ..... 166/281; 166/283; 166/297; 166/308.1

(58) Field of Classification Search ..... None
See application file for complete search history.

(56) References Cited

U.S. PATENT DOCUMENTS 3,608,639 A * 9/1971 Hart ..... 166/308.2
5,529,123 A * 6/1996 Carpenter et al. ..... 166/293
2004/0177961 A1* 9/2004 Nguyen ..... 166/280.2
2006/0122071 A1* 6/2006 Reddy et al. ..... 507/219
2007/0017675 A1* 1/2007 Hammami et al. ..... 166/278

FOREIGN PATENT DOCUMENTS

RU 2079644 5/1997

OTHER PUBLICATIONS

Boukhelifa et al., "Evaluation of Cement Systems for Oil and Gas Well Zonal Isolation in a Full-Scale Annular Geometry", IADC/SPE 87195, Mar. 2-4, 2004.
Timoshenko et al., "Theory of Elasticity", pp. 90-91, McGraw-Hill Book Co., 1970.

* cited by examiner

*Primary Examiner* — Zakiya W. Bates
(74) *Attorney, Agent, or Firm* — Vincent Loccisano; James McAleenan; Brigid Laffey

(57) ABSTRACT

The invention relates to oil production stimulation methods and can be used for both reservoirs with fractures resulting from the fracturing procedure and reservoirs with naturally occurring fractures, for which the fracturing procedure is not mandatory. A material which expands while hardening or setting, is injected into the near-wellbore region of a cased well, into the space between the casing and the reservoir, and the wellbore is then perforated. A material having an expansion degree sufficient for application of pressure to the wellbore walls and for keeping at least one fracture open is used as the material which expands while hardening or setting. After the perforation has been done, the reservoir is hydraulically fractured. For naturally fractured reservoirs, the fracturing procedure is not mandatory.

10 Claims, No Drawings

WELL PRODUCTIVITY ENHANCEMENT METHODS

CROSS-REFERENCE TO RELATED APPLICATIONS

This application claims the benefit of priority to Russian Patent Application No. 2006133834 filed Sep. 22, 2006, which is herein incorporated by reference.

FIELD OF THE INVENTION

This invention generally relates to oil production stimulation methods.

BACKGROUND OF THE INVENTION

To stimulate the production, low-permeability rock (methane-containing coal beds, shales, dense gas-bearing sandstones) is often hydraulically fractured, using a small amount of proppant and sometimes even without using it. This opens naturally occurring fractures and microfractures in the reservoir or generates new fractures which may improve considerably the hydrodynamic connection between the reservoir and the wellbore. However, it is impossible to predict the fracture opening degree as there is a wide variety of influencing factors. Therefore, it is often impossible to select a proper type of proppant. As a result, most of fractures close after the fracturing pressure has been relieved. Moreover, proppant preparation, manufacturing and grading processes take a lot of time.

Intense injection of nitrogen into a reservoir (i.e. injection of pure nitrogen into very low-permeability rock) is a typical example of the proppant-free fracturing. The produced fracture is expected to maintain a sufficient degree of permeability for efficient production, taking into account low permeability of the reservoir. However, the wellbore/fracture network connection caused by stress concentration around the wellbore is still one of the main problems.

There is a common well productivity enhancement method according to which a slurry of a nonexplosive breaking agent that expands while hardening, is injected into a well as a fracturing fluid, at a hydration pressure exceeding the displacement pressure. The reservoir is then hydraulically fractured, the fracturing fluid is displaced with a displacement fluid until a near-wellbore fractured region free of fracturing fluid is formed, and the well is kept under displacement pressure until the fracturing fluid hardens in the fractures (RF Patent No. 2079644, 1997). The said method provides generation of additional fractures or additional opening of existing fractures. The produced fractures are not filled with a hard material but remain empty or are filled with a reservoir fluid, thus increasing the permeability of the near-wellbore region and enhancing the productivity of the well.

However, this method offers no solution to the problem that arises in the near-wall region where the stress which causes the fractures to close has the highest value and increases as the pressure decreases in the wellbore. The fracture mouth plugging hampers the optimization of oil production and is the main disadvantage of this method and of many other well-known techniques.

SUMMARY OF THE INVENTION

It is therefore an aspect of the invention to provide a method that allows for the prevention of fractures from closing in the near-wellbore region and provides reliable connection of the fracture network to the wellbore. This method can be used for both reservoirs with fractures resulting from the fracturing procedure and reservoirs with naturally occurring fractures, for which the fracturing procedure is not mandatory.

DETAILED DESCRIPTION OF THE INVENTION

According to the well productivity enhancement method, a material which expands while hardening or setting, is injected into the near-wellbore region of a cased well, into the space between the casing and the reservoir, and the wellbore is then perforated. A material having an expansion degree sufficient for application of pressure to the wellbore walls and for keeping at least one fracture open is used as the material which expands while hardening or setting. After the perforation has been done, the reservoir is hydraulically fractured. For naturally fractured reservoirs, the fracturing procedure is not mandatory.

The stress $\sigma_\theta$ which causes the mouth of a fracture to close in the absence of proppant near the wellbore wall can be calculated as a tangential stress on the wellbore wall in the absence of a fracture:

$$\sigma_\theta=2\sigma_h-P_w+2\eta(P_w-p)$$

where $\sigma_h$ is the main stress in the far region on the horizontal plane, $P_w$ is the wellbore pressure, p is the pore pressure in the far region and 2 $\eta$ is the elastic constant of the porous medium, being close to 0.5.

The equation is based on the assumptions that rock is a porous elastic material, that the well has been drilled parallel to the main vertical stress and that two main horizontal stresses in the far region are equal.

It should be noted that the stresses which occur in the near-wellbore region quickly reduce to zero when moving away from the well. Consequently, they affect nothing but the near-wellbore region, and the stress $\sigma_\theta$ which causes the fracture to close quickly approaches to the horizontal stress $\sigma_h$ in the far region at a distance of about two wellbore diameters from the well. The full equation on elasticity can be found in the following referenced paper, "Timoshenko, S. P., and Goodier, J. N.: Theory of Elasticity, 3rd ed., McGraw-Hill Book Company, New York (1970)."

During the production, the reservoir fluid pressure is lower than the pore pressure in the far region and is inevitably lower than the stress in the far region. Consequently, the tangential stress in the near-wall region (i.e. the stress which causes the fracture to close on the fracture surface) increases.

To make up for wellbore pressure reduction, a material which expands while hardening or setting and which allows application of a radial stress to the wellbore walls, is placed in the near-wellbore region between the casing and the rock. This allows separation of the wellbore pressure from the radial stress applied to the wellbore walls at the border of the material which expands while hardening or setting, and the rock. As a result, the following formula is applicable:

$$\sigma_\theta=2\sigma_h-P_w^s+2\eta(P_w^f-p)$$

where $P_w^s$ is the radial stress applied to the wellbore walls and $P_w^f$ is the wellbore pressure.

This radial stress must be high enough to reduce the tangential rock stress $\sigma_\theta$ (we assume that compression is positive) in the near-wellbore region at least to the far region value or, in a better case, to a level below the far region value or, in the extreme case, to a level below the tensile strength value.

Let us consider a shallow reservoir, say, 1,000 meters in depth, having a pore pressure (p) of 10 MPa in the far region and a minimum stress of about 18 MPa. Let us assume that the wellbore pressure $p_w^f$ is equal to 3 MPa during the production, the elastic constant of the porous medium 2 $\eta$ is equal to 0.5, the stress $\sigma_\theta$ which causes the fracture to close in the near-wall region is equal to 29 MPa, which is a considerable increment as compared with 18 MPa. Additional load of 11 MPa is to be applied to the rock to make up for the stress which causes the fracture to close.

Cement that contains D179 expanding agent (magnesium oxide) is an example of the material which expands while hardening. It is possible to use other expanding materials that provide sufficient pressure, e.g. polymers capable of swelling and materials having elastic recovery properties. Some of these materials expand so much that they can break strong rock when injected to a small diameter hole, and they are used, for example, in the mining industry. To determine the load applied to the rock by an expanding material, it is possible to use the pilot unit described in Boukhelifa L., Moroni N., Lemaire G., James S. G., Le Roy-Delage S., Thiercelin M. J., "Evaluation of Cement Systems for Oil and Gas Well Zonal Isolation in a Full-Scale Annular Geometry", SPE 87195, Proceedings of the IADC/SPE Drilling conference, Dallas, Tex., 2-4 March 2004.

The application of a material that expands while hardening or setting, between the casing and the reservoir increases the normal load on the wellbore wall. In case of a sufficiently high load, the stress which causes the mouth of the fracture to close reduces to a degree sufficient for maintaining a required conductivity level. In a better case, it is possible to create a tensile stress at which the mouth of the fracture will remain open.

In the preferred embodiment of the present invention, is a material that expands while hardening or setting, and can be injected into the near-wellbore region of a cased well, into the space between the casing and the reservoir, prior to starting the perforating and fracturing procedures. A material having an expansion degree sufficient for application of pressure to the wellbore walls and for keeping at least one fracture open should be used as the material which expands while hardening or setting.

The material may expand before the perforating and fracturing procedures begin, but this is not mandatory; the idea is to achieve full expansion during the production.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A well productivity enhancement method that includes injection of a material which expands while hardening or setting, the material which expands while hardening or setting is injected into the near-wellbore region of a cased well, into the space between the casing and the naturally fractured reservoir, and then the wellbore is perforated, such that the characteristics of the material include an expansion degree sufficient for application of pressure to the wellbore walls and for keeping at least one fracture open in the naturally fractured reservoir.

2. A method according to claim 1, wherein:

after the wellbore has been perforated, the reservoir is additionally fractured.

3. A method according to claim 1, wherein:

said material which expands while hardening or setting is an expanding cement that is selected from a group consisting of calcium oxide or magnesium oxide or any combination thereof.

4. A method according to claim 1, wherein:

said material which expands while hardening or setting is a swelling polymer which expands in the presence of oil or water.

5. A well productivity enhancement method that includes injection of a material which expands while hardening or setting, the material which expands while hardening or setting is injected into the near-wellbore region of a cased well, into the space between the casing and the reservoir, then the wellbore is perforated and the reservoir is hydraulically fractured, such that the characteristics of the material include an expansion degree sufficient for application of pressure to the wellbore walls and for keeping at least one fracture open.

6. A method according to claim 5, wherein:

said material which expands while hardening or setting is an expanding cement that is selected from a group consisting of calcium oxide or magnesium oxide or any combination thereof.

7. A method according to claim 1, wherein:

said material which expands while hardening or setting is a swelling polymer which expands in the presence of oil or water or any combination thereof.

8. An oil production stimulation method includes a material which expands while hardening or setting, the material is injected into a near-wellbore region of a cased well, into a space between a casing and a fractured reservoir, prior to the starting of perforating and fracturing procedures, wherein the wellbore is then perforated due to the material having an expansion degree sufficient for keeping at least one fracture open in the fractured reservoir.

9. A method according to claim 8, wherein:

said material is an expanding cement selected from a group consisting of calcium oxide or magnesium oxide or any combination thereof.

10. A method according to claim 8, wherein:

said material is a swelling polymer which expands in the presence of oil or water or any combination thereof.

* * * * *